United States Patent [19]

Bleyl

[11] 3,948,196

[45] Apr. 6, 1976

[54] APPARATUS FOR BURNING FLUID AT A BURNER MOUNTED ON A FLOATING VESSEL SUBJECT TO WAVE ACTION

[75] Inventor: Donald L. Bleyl, Houston, Tex.

[73] Assignee: Brown & Root, Inc., Houston, Tex.

[22] Filed: July 18, 1975

[21] Appl. No.: 597,164

[52] U.S. Cl. ..... 114/.5 D; 166/.5; 431/202

[51] Int. Cl.[2] ..... B63B 35/02

[58] Field of Search..... 114/.5 R, .5 D, 74 R, 74 A; 9/8 P; 166/.5; 169/69; 175/5, 7; 431/2, 202; 214/12; 212/3

[56] References Cited

UNITED STATES PATENTS

| | | | |
|---|---|---|---|
| 3,503,443 | 3/1970 | Blanding et al. | 9/8 P X |
| 3,557,396 | 1/1971 | Rupp | 9/8 P |
| 3,608,630 | 9/1971 | Wooden | 166/.5 |
| 3,807,932 | 4/1974 | Dewald | 431/2 |
| 3,875,998 | 4/1975 | Charpentier | 166/.5 |
| 3,880,573 | 4/1975 | Simmons | 431/202 |
| 3,881,549 | 5/1975 | Thomas | 166/.5 |

*Primary Examiner*—Trygve M. Blix
*Assistant Examiner*—Sherman D. Basinger
*Attorney, Agent, or Firm*—Kenway & Jenney

[57] ABSTRACT

Apparatus for burning fluid at a burner mounted on a floating vessel subject to wave action, the apparatus including a floating vessel, a generally upright pedestal, and a boom mounted in a centilever manner on a pivot member supported for swinging movement on the pedestal. A burner is carried by an outer portion of the boom. An outrigger is mounted on the pedestal and supports a drive member which is drivingly engaged with the pivot member, with the drive member being operable to effect swinging movement of the pivot member and the boom about the pedestal. A wave-action-accommodating mechanism is operable to sense the effects of wave-action-induced force acting on the boom and restrain or impede undesired swinging movement of the boom which would otherwise be induced by such wave-action-induced force.

5 Claims, 7 Drawing Figures

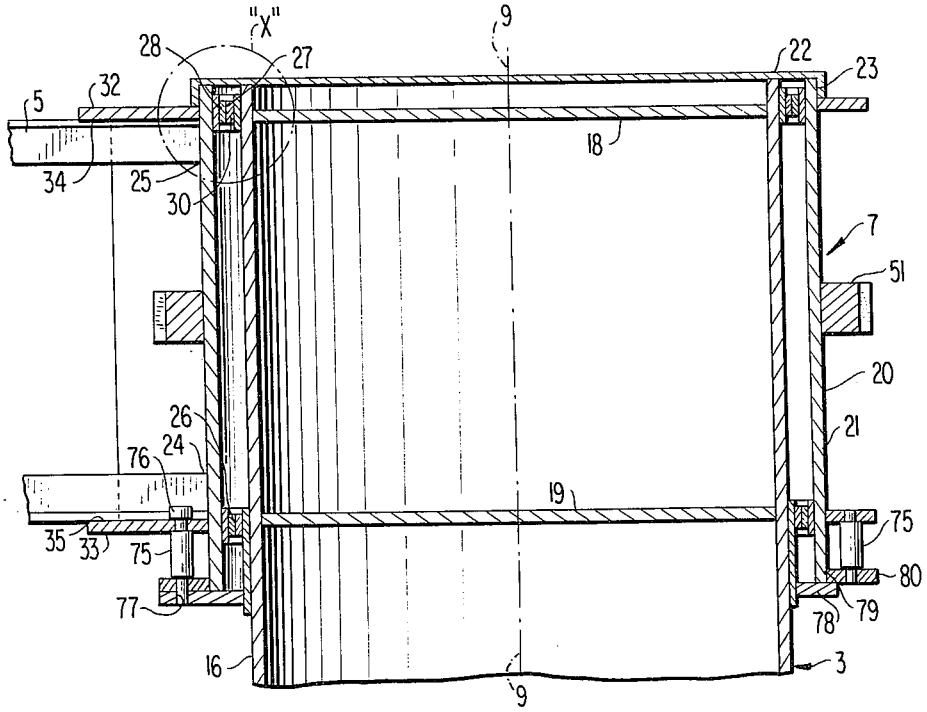
FIG. 3
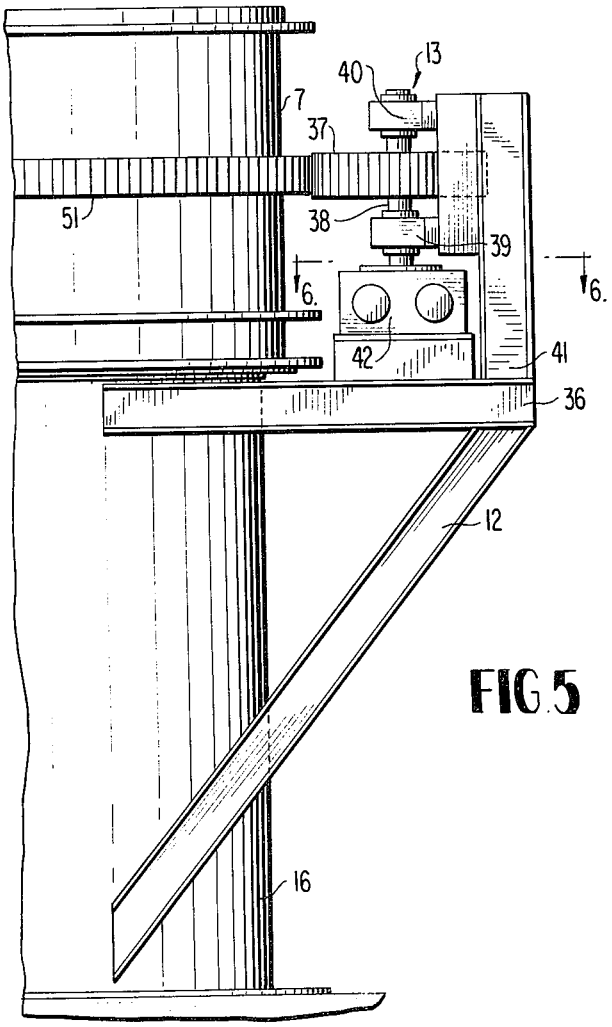
FIG. 5
FIG. 4
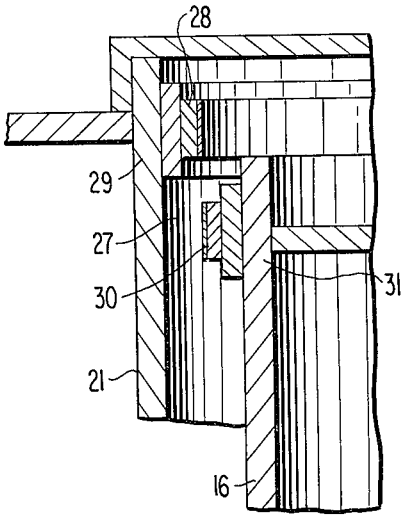

APPARATUS FOR BURNING FLUID AT A BURNER MOUNTED ON A FLOATING VESSEL SUBJECT TO WAVE ACTION

BACKGROUND OF INVENTION

This invention relates to apparatus which may be employed to effect the disposal of inflammable fluids at offshore locations.

In particular, the invention is concerned with apparatus which may be utilized for burning fluid at a burner which is mounted on a floating vessel, with the vessel being subject to wave action.

The offshore, fluid-burning apparatus here under consideration is particularly useful in connection with offshore oil and gas operations where, from time to time, it becomes necessary to dispose of oil or gas by burning.

An apparatus which is particularly useful for effecting the disposal by burning of oil and/or gas at offshore locations comprises an Otis/NAO"CB" burner featured for example at pages 80 and 81 of the Jan. 20, 1975 issue of *The Oil and Gas Journal*, published by The Petroleum Publishing Company, 211 S. Cheyenne, Tulsa, Okla., 74101; this burner being available from Otis Engineering Corporation, P. O. Box 34380, Dallas, Tex., 75234.

Within the context of the present invention, a burner as above described is intended to be mounted on a floating vessel, such as a conventional service boat utilized in connection with offshore oil and gas operations. Fluid to be burned would be transferred to and/or accumulated on such a service vessel and burned through operation of a burner of the type heretofore noted.

In effecting such disposal-by-burning operations, it is desirable to position the burner at a location outboard of the floating vessel, and at a desired location with respect to wind and/or wave conditions with respect to the vessel.

Such positioning necessitates the utilization of reliable burner-positioning equipment.

Desirably, such positioning should be effected with apparatus involving minimal modification of existing vessel structure, minimum usurpation of available space on the service vessel, and maximum control over positioning movements of the burner. Such positioning control enables an operator to affirmatively avoid damaging structural interaction between the burner and vessel superstructure and avoid damage to burner-manipulating equipment which might be occasioned by wave-action-induced forces.

Bearing such general criteria in mind, the present invention affords an apparatus for manipulating a burner on an offshore vessel, which apparatus is characterized by optimized structural simplicity and reliability, and a unique degree of safety in connection with control over burner-manipulating operations.

SUMMARY OF INVENTION

The present invention contemplates an apparatus for burning fluid at a burner which is mounted on a floating vessel, which vessel is subject to wave-action-induced forces.

The apparatus includes floating vessel means, generally upright pedestal means, and boom means mounted for swinging movement across the surface of a body of water upon which the floating vessel means is floating.

The pivot means, journaled onto the pedestal means, supports an inner portion of the boom means for this swinging movement. A burner means is carried by an outer portion of this boom means.

An outrigger means is mounted on the pedestal means. A drive means, carried by the outrigger means, is operable to engage and drive the pivot means so as to effect the desired swinging movement of the boom means and position the burner means at a desired location, outboard of the floating vessel means.

A wave-action-accommodating means included in the apparatus is operable to sense the effects of wave-action-induced force acting on the boom means and tending to induce swinging movement of the boom means about the pedestal means. This wave-action-accommodating means is further operable to apply a restraining force to the pivot means so as to tend to counteract the wave-action-induced force acting on the boom means and tend to induce swinging movement of the boom means about the pedestal means.

A collateral, and independently significant aspect of the invention, relates to an upright column and column-closing cap means which constitute the pedestal and pivot means of the aforementioned combination.

Still another independently significant facet of the invention resides in aspects of the drive means entailing a pinion, rack and linearly reciprocal piston assembly. The drive means cooperates with a ring gear carried by the cap of the pivot means to effect the desired swinging or rotary movement of the pivot means and the boom means about the pedestal means, particularly so as to limit such swinging movement to a desired increment so as to avoid interference with the vessel superstructure.

A still further, independently significant, facet of the invention involves hydraulic circuit aspects of the wave-action-accommodating means. Such aspects include a unique load-sensing arrangement which is operable to cause the drive means to automatically counteract wave-action-induced swinging movements of the boom and pivot means.

The entire combination of independently significant combinations, as noted above, constitutes a preferred and optimized embodiment of the invention.

With respect to this preferred embodiment and the other combinations above noted, reference will be made by way of example, but not by way of limitation, to the exemplary embodiment illustrated in the appended drawings.

DRAWINGS

The appended drawings depict a presently preferred embodiment of the invention, described in the context of a burner boom which is pivotally mounted on an upright pedestal. This pedestal is mounted on a floating service boat of the type used in connection with offshore oil and gas operations.

As shown in the drawings:

FIG. 1 provides a fragmentary, generally schematic, elevational view of a bow portion of a service boat, depicting an upright pedestal upon which a burner-supporting boom is pivotally mounted;

FIG. 2 provides a top plan view of the fragmentary portion of the service vessel depicted in FIG. 1;

FIG. 3 provides an enlarged fragmentary, vertically sectioned view of a portion of the pedestal pivot and boom assembly shown in FIGS. 1 and 2, as viewed along section line 3—3 of FIG. 2;

FIG. 7 provides a still further enlarged view of telescopingly separated pivot and pedestal elements of the FIG. 3 assembly, corresponding to the component area X of FIG. 3;

FIG. 5 provides an enlarged, side elevational view of the pedestal, pivot, and drive assembly of the FIG. 1 apparatus;

FIG. 6 provides a further enlarged, horizontal sectional view of a portion of the drive assembly depicted in FIG. 5, with a portion of the drive assembly being in part "broken away," as viewed along section line 6—6 of FIG. 5; and FIG. 7 provides a schematic illustration of the hydraulic system incorporated with the FIG. 5 drive mechanism.

DETAILED DESCRIPTION

In describing the invention, reference will be made to a preferred embodiment of the invention, set forth in the context of a representative offshore operation.

The detailed description will proceed from a general discussion of the basic overall combination of the invention, to more detailed discussions concerning the pedestal and pivotal means of the invention, the drive means of the invention, the wave-action-accommodating means of the invention, and commercial components and collateral details useful in the performance of the invention as presently contemplated.

1. Overall Combination

Figure 1:
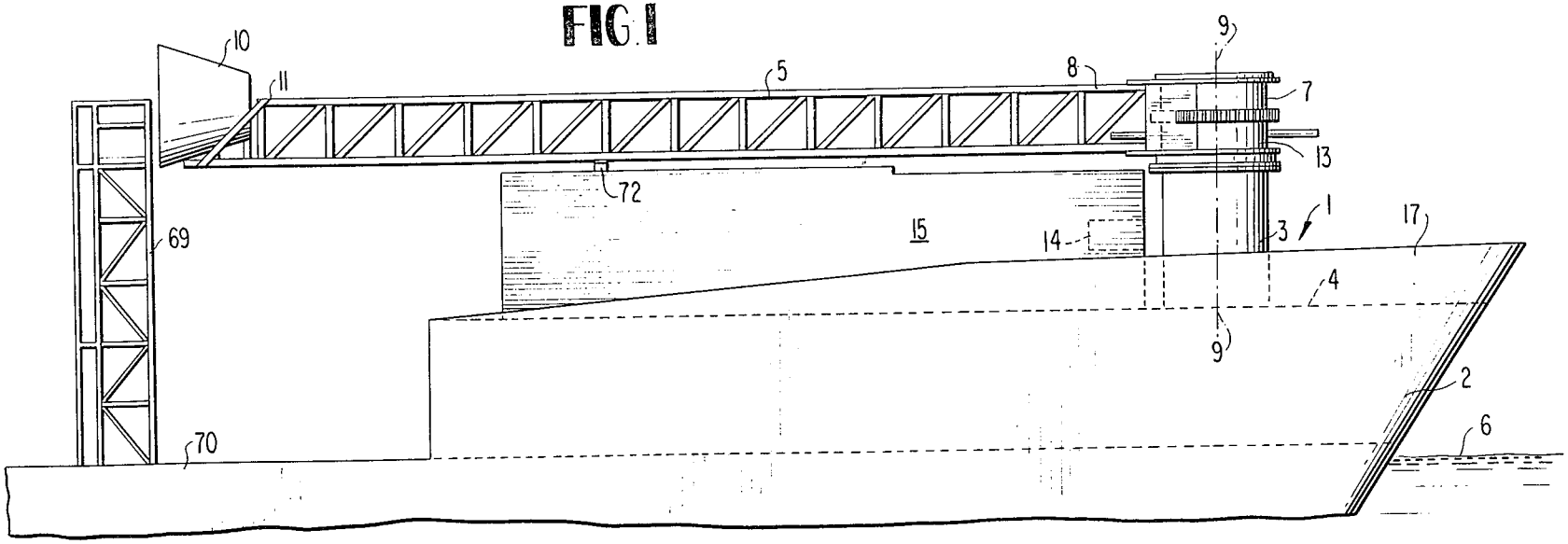
Figure 2:
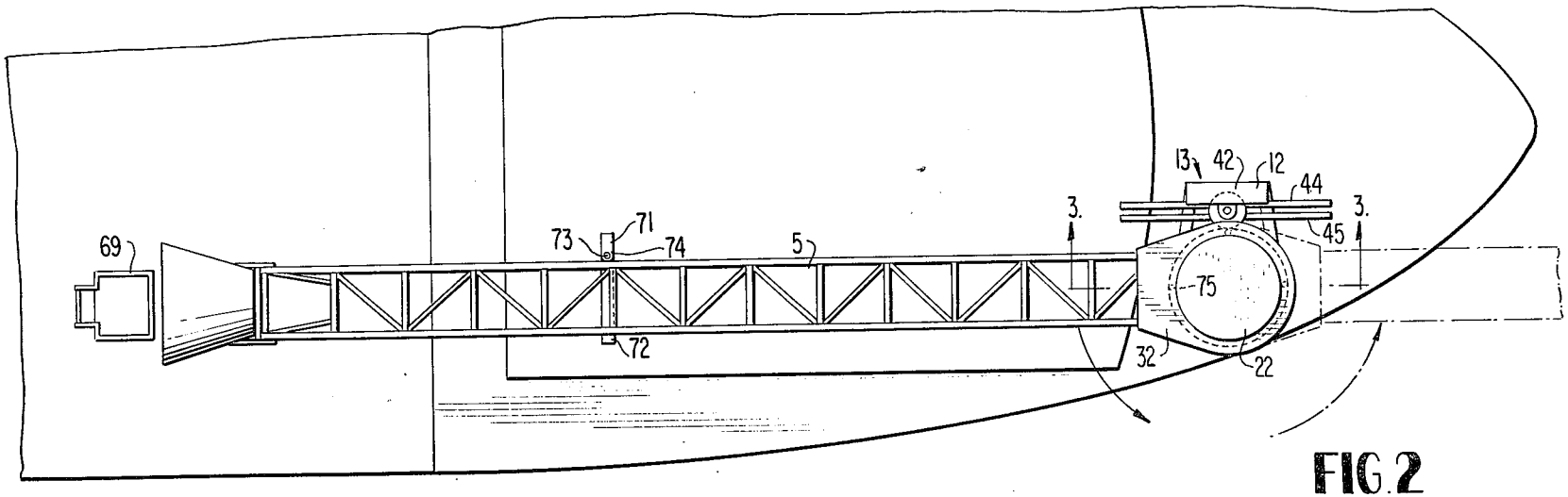

The overall combination, characterizing a preferred embodiment of all aspects of the invention, is depicted in FIGS. 1 and 2.

As shown in these figures, an overall apparatus 1 is provided for burning fluid at a burner which is mounted on a floating vessel 2, which vessel is subject to wave action.

The apparatus 1 includes a conventional floating vessel 2 and may comprise the usual type of service boat used in offshore operations in connection with the development of petroleum resources.

Apparatus 1 further includes a generally upright pedestal means 3 which is mounted on the deck 4 of the vessel 2 so as to project generally vertically upwardly from the deck 4, when the deck 4 is in a normal horizontal position.

Apparatus 1 further includes a truss-like boom means 5. Boom means 5 is mounted for swinging movement across the surface of a body of water 6 upon which the floating vessel 2 is floating.

A pivot means 7 is journaled on the pedestal means 3 and supports an inner portion 8 of the boom means 5 for swinging movement, i.e., rotary movement in a generally horizontal plane about the vertical axis 9 of the pedestal means 3 (when the deck 4 is horizontal).

A burner 10 is carried by an outer portion 11 of the boom means 5. As earlier noted, burner 10 desirably will comprise an Otis/NAO"CB" burner which is uniquely designed for the burning of oil and gas products developed in connection with offshore operations.

An outrigger means 12, carried on the port side of the pedestal 3 as depicted in FIGS. 1 and 2, is mounted on the pedestal 3. A drive means 13 is carried by the outrigger means 12. This drive means 13 is operable to engage and drive the pivot means 7 so as to effect the aforesaid swinging or rotary movement of the boom means 5 about the pedestal and its "vertical" axis 9.

A control mechanism, comprising wave-accommodating means 14 which may be located in the control house 15 of the floating vessel 2 or any other convenient location on the vessel, is operable to perform multiple control functions in relation to the implementation of swinging movement of the boom 5.

Wave-action-accommodating means 14 is operable to sense the effects of wave-action-induced force acting on the boom means and tending to induce swinging movement of the boom means 5 about the pedestal means 3. Such sensing could occur, for example, when wave action tends to cause the boom 5 to "fall" or undergo rotary movement in a generally downward direction, due to wave-action-induced tilting of the vessel 2.

In addition to detecting such "falling" of the boom 5, which could produce excessive rates of boom movement and thus damage the boom, the pedestal, the vessel superstructure, etc., the wave-action-accommodating means 14 is operable to apply an appropriate corrective or restraining force to the boom 5 via the drive means 13. Thus, wave-action-accommodating means 14 is operable to apply a restraining force to the pivot means 7 via operation of the drive means 13 so as to tend to counteract wave-action-induced force acting on the boom 5 and tending to induce undesired swinging movement of the boom 5 in the aforesaid "falling" manner about the pedestal 3.

As will be appreciated, the action of the wave-action-accommodating means comes into play while an operator, effecting normal operation of the drive means 13 via a control station 15, is selectively positioning the boom 5 relative to the vessel 2 so as to locate the burner 10 at a desired outboard location with respect to the vessel. Such positioning will involve the operator taking into account existing wave and wind conditions and adjacent structures and/or vessels.

When the boom 5 is positioned as desired, with burner 10 located outboard of vessel 2, fluid to be burned may be transmitted along boom 5 to burner 10 via appropriate conduits extending from a source and carried by boom 5.

Having described the basic combination of the invention, it is now appropriate to proceed with a discussion of structural details concerning the pedestal and pivot means, the drive means, and the wave-action-accommodating means.

2. Details of Pedestal Means and Pivot Means

Structural details of the pedestal means 3 and pivot means 7 are depicted in FIGS. 3, 4 and 5.

As shown in these figures, the pedestal means 3 comprises a generally upright tubular column 16 encircling the pivot axis 9. Column 16 is mounted so as to project generally vertically upwardly from deck 4, when deck 4 is horizontally oriented.

In the embodiment depicted in FIG. 1, the column 16 is mounted on a bow portion 17 of the vessel 2 such that it remains under optimized observation with respect to operators located in the control house 15.

Column 16 may also be provided with internal, transversely extending reinforcing walls such as the walls 18 and 19, depicted in FIG. 3.

Pivot means 7, as shown in FIG. 3, may comprise a cap-like structure 20 formed from a cylindrical body 21 which is capped by a transverse closure or upper end wall 22. End wall 22 may be joined to side wall 21 by welding at juncture 23.

As is depicted in FIG. 3, the boom 5 is welded to the cap cylinder portion 21 for example at junctures 24 and 25 such that boom 5 is supported in a horizontally extending, cantilever manner from the cap means 20.

As will also be appreciated, reinforcing of the mounting of the boom 5 on the cap 20 may be facilitated by upper and lower mounting plates 32 and 33. Mounting plates 32 and 33 would be generally similar in configuration, with each such plate providing a supporting web portion projecting horizontally along the boom 5 and affixed to the boom 5 as by welding. Thus, as shown in FIG. 3, boom 5 is received between web portions 34 and 35 of plate means 32 and 33, respectively.

Cap means 20 is journaled on pedestal column 16 for rotary or swinging movement about the axis 9 and this journal-type mounting is facilitated by upper and lower ring-type bearing means 26 and 27.

Bearing structures 26 and 27 are substantially identical, such that it is appropriate to consider structural details of only one such bearing ring.

Thus, as shown in FIG. 4, bearing 27 may comprise an annular bearing ring 28 carried by the inner periphery of the upper portion 29 of wall 21. A mating annular bearing ring 30 is carried by an upper portion 31 of the pedestal column 16. FIG. 4 shows the normally telescopingly received bearing rings 28 and 30 in a telescopingly separated condition for convenience of illustration. However, during normal operation, the bearing rings 28 and 30 would be telescoped into mutually contiguous, bearing-defining relation as shown in FIG. 3.

3. Details of Drive Means

Figure 6:
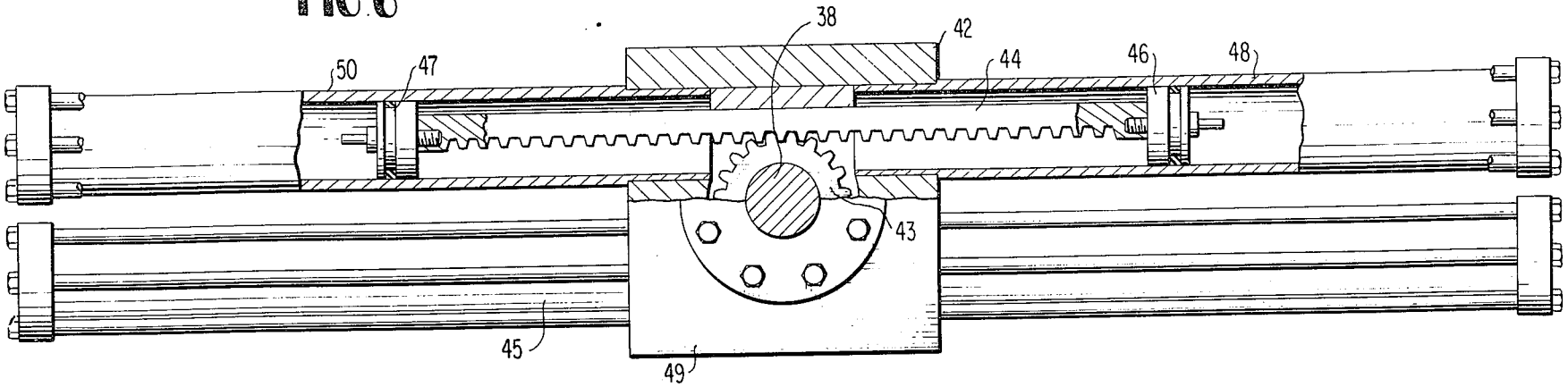

Structural details of the drive means 13 are depicted generally in FIGS. 5 and 6.

As shown in FIGS. 5 and 6, a truss-defined, outrigger assembly 12 projects from the port side of the pedestal column 16 and is affixed thereto. Outrigger 12 includes a generally horizontally extending platform portion or frame portion 36 which may be located generally beneath the lower terminus of the cap 20.

Outrigger 12 thus provides a platform-like support 36 upon which the drive means 13 is supported, in a outrigger fashion, generally outboard of, but adjacent, the pivotal cap 20.

Drive means 13 includes a drive pinion 37 which is mounted upon an upright drive shaft 38. Drive shaft 38 is journaled in bearing assemblies 39 and 40 which are supported by an upright portion 41 of the outrigger mounting 12.

Shaft 38 projects into the interior of a hydraulically actuated rack and pinion drive motor assembly 42, details of which are depicted in FIG. 6.

As shown in FIG. 6, drive motor 42 includes a motor-housed drive pinion 43 connected with the drive shaft 38 and engaged on opposite sides by paired, parallel reciprocable, oppositely moving toothed rack drive units 44 and 45 (both drive racks being the same, and only one being illustrated in a cutaway format in FIG. 6).

Each drive rack is drivingly engaged with the pinion 43 and is provided at each of its opposite ends with a hydraulic drive piston. Thus, rack 44 is provided with drive pistons 46 and 47 at each of its opposite ends. Drive piston 46 is telescopingly received within a cylinder 48 projecting horizontally from pinion housing 49. Similarly, piston 47 is telescopingly received within a generally horizontally extending cylinder 50 projecting from housing 49, away from, and oppositely relative to, the piston 48.

As will be appreciated, fluid pressure applied to either the piston 46 or the piston 47 via their respectively associated cylinders (applied to the outer faces of the pistons) will induce linear or reciprocable movement of the rack associated with the piston so as to in turn induce rotary movement of the pinion 43. Rack assemblies 44 and 45 will be operated in opposite directions, but coordinated manners, so as to provide a dual motivating influence on the drive pinion 43, with drive action thus being balanced on opposite sides of the pinion 43 and the drive shaft 38.

The manner in which fluid is supplied to the cylinder means associated with the drive pistons, and exhausted therefrom, is conventional in nature and will be described at somewhat greater length with respect to the ensuing discussion of the wave-action-accommodating means.

At this juncture, it is to be noted that the length of each of the racks 44 and 45 is such as to limit rotational movement of the drive shaft 38 such that the driving influence of the pinion 37 will induce rotation of the cap 20 and boom 5 through less than a whole circle of revolution. This limited degree of rotary swinging movement will insure that the boom 5 does not inadvertently travel into structurally damaging relation or proximity with respect to superstructure of the vessel 2.

Driving cooperation between the drive means 13 and the pivot means 7 is effected by an annular ring gear 51, depicted in FIG. 5. This ring gear 51 is matingly engaged with the pinion 37 and is carried on the outer periphery of the wall 21 of the cap 20.

As will be appreciated, the extent of travel of the rack means 44 and 45 and the diameters of the pinion gear 43, the ring gear means 51, and the pinion gear means 37 cooperate to insure that the swinging movement of the boom means 5 and pivot means 7 is limited. It is contemplated for example that, as depicted in FIG. 2, this swinging movement would be limited to approximately 180° as the boom is moved from an aft-extending orientation to a full forward-extending orientation, swinging forward and to the starboard side and outboard of the vessel 2.

4. Details of Wave-Action-Accommodating Means

Figure 7:
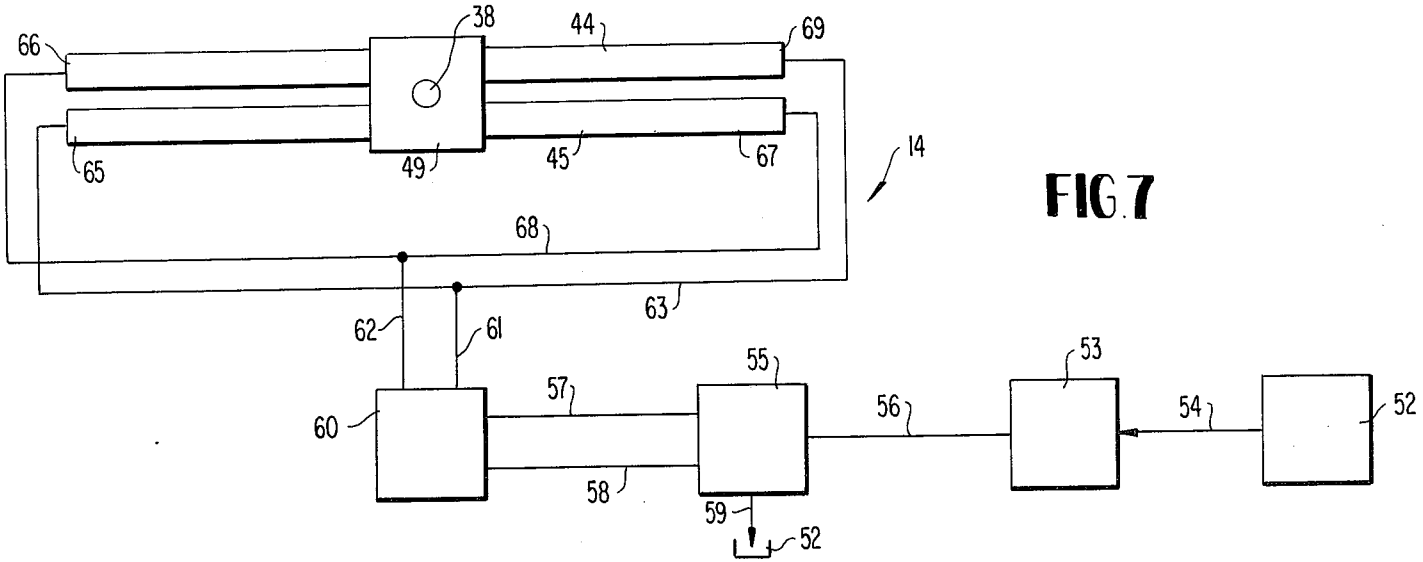

Structural details and hydraulic circuit details of the wave-action-accommodating means 14 may be appreciated by reference to the schematic drawing depicted in FIG. 7.

As shown in FIG. 7, a wave-action-accommodating means comprises a sump 52 or source of hydraulic fluid which may be located as desired in relation to the drive assembly 13. By way of convenience, the sump 52 has been illustrated in FIG. 7 at two locations, the location on the right being indicative of the function of sump 52 as the source of hydraulic fluid including a pump, and the location in the intermediate portion of FIG. 7 depicting the return flow function of the sump 52.

Wave-action-accommodating means 14 further includes a flow-rate-control means or flow-regulating valve 53 which is operable to regulate the flow rate of hydraulic fluid from the source 52 via connecting hydraulic flow line means 54.

A flow-direction-control means 55 receives hydraulic fluid from flow-rate-control means 53 via supply passage means 56. Flow-direction-control means 55 may comprise a four-way, three-position, hydraulic control valve operable to selectively direct pressurized fluid from supply conduit 56 to either of output hydraulic conduits 57 or 58. This control valve will also automatically cause whichever of the conduits 57 or 58 is not receiving pressurized fluid from the control means 55 to function as a vent conduit, operable to return hydraulic fluid through unit 55 to sump 52 via return passage 59.

Hydraulic conduits or passages 57 and 58 communicate with a load-sensing and force-correcting unit 60.

Unit 60 may comprise a conventional, commercially available, hydraulic counterbalance and over-center control valve which will serve to automatically switch the direction of output fluid from the unit 60, depending upon load conditions acting on the boom 5.

Thus, as shown in FIG. 7, control unit 60 is provided with two output lines 61 and 62, each of which communicates with drive-fluid-transmitting loop lines.

Output conduit 61 communicates with a loop 63 which in turn communicates with the right end 64 of the cylinder assembly associated with rack 44 and communicates with the left end 65 of the hydraulic unit associated with the rack means 45. When hydraulic fluid is thus directed into the loop 63, the oppositely directed movements of the racks 44 and 45 (to the left and right, respectively) will induce counterclockwise rotation of the shaft 38 and clockwise rotational movement of the boom 5, viewing the boom 5 as shown in FIG. 2.

During this boom movement, fluid will be vented from the other cylinder ends 66 and 67 of the cylinder assemblies associated with rack means 44 and 45, respectively, into loop 68. Return fluid passing into loop 68 will return through control unit 60 via connecting conduit 62, for transmittal via conduit 58 and control valve 55 into passage 59 for return to sump 52.

As will be appreciated, the reverse flow conditions will exist when the unit 60 is supplying pressurized fluid to loop 68 via conduit 62. Under these circumstances, pressurized fluid will be supplied to the right end 67 of the cylinder assembly associated with rack means 45 and the left end 66 of the cylinder means associated with rack means 44 so as to induce rightward and leftward movements, respectively, of the rack means 44 and 45. Such movements will induce clockwise rotation of the drive shaft 38 and counterclockwise rotation of the pivot means 7 and boom means 5, as shown in FIG. 2.

Control unit 60, in a conventional manner, will sense either excessive pressure conditions in a vent line returning from the cylinders of the rack-driving piston means, and/or an excessively low pressure in the feed line associated with these systems, recognizing of course that such excessively high or excessively low pressure conditions would be indicative of the boom means 5 tending to move away from the driving influence of the drive means 13.

Thus, if fluid should be supplied to the conduit 62, with the unit 60 being in its normal or non-correcting mode, the boom would ordinarily tend to be rotated in a counterclockwise direction. However, if during this movement, wave action should cause the bow and/or starboard side of the vessel 2 to be depressed, the boom 5 would tend to rotate or "fall" forward and such movement would reduce the pressure in the feed line 62 and tend to increase pressure in the return line 61. The nature of the conventional control mechanism 60 is that it will detect at least one (or possibly both) of these extraordinary or unusual conditions and automatically reverse the functions of conduits 61 and 62. In other words, this conversion will cause fluid to be supplied to conduit 61 so as to impede the "falling" of counterclockwise rotation of the boom 5 so as to prevent excessive boom movements while the boom is being selectively manipulated or positioned.

This automatic reversal of the direction of driving force thus entails, through the sensing of pressure conditions in the conduit means 61 and/or 62, the sensing of the effects of wave-action-induced force acting on the boom means and the automatic application of a reversal of the direction of applied fluid to the cylinder means associated with the drive mechanism so as to develop a restraining force acting on the pivot means 7 and tending to counteract the wave-action-induced force acting on the boom means 5.

With the general operating characteristics of the wave-action-accommodating means 14 having been described with reference to FIg. 7, it now becomes appropriate to identify commercially available components which may be utilized in the circuit depicted in this figure.

5. Commercial Components and Collateral Aspects of Invention

While a variety of control valve components may be employed in implementing the circuitry depicted in FIG. 7, it is deemed appropriate at this juncture to identify representative commercially available components which may be utilized, for example, in connection with the manipulation of a boom 5 approximately 60 feet in length.

With such a boom, it is contemplated that the drive motor 42 may comprise a hydraulically actuated rotary actuator, having a five-inch diameter drive shaft, identified as part number HC-2000-540-MSI-F-O, and available from the Ohio Oscillator Company, Inc., P. O. Box. 1069, 1250 St. George Street, East Liverpool, Ohio, 43920.

The hydraulic flow-rate-control valve 53 may comprise a pressure-compensated hydraulic flow-control valve, part number 13-A32-F-6-21, available from Fluid Power Systems, 511 South Glenn Avenue, Wheeling, Ill., 60090.

The hydraulic flow-direction-control valve 55 may comprise a hydraulic manual selector valve, part number 6144R3HC3-MC, available from Delaval Barksdale Controls Division, 5125 Alcoa Avenue, Los Angeles, Calif., 90058.

The wave-action-accommodating, load-sensing, and output-reversing or modifying valve 60 may comprise a hydraulic counterbalance and over-center control valve; part number 2-45-B-6P-25-3100-075, available from Fluid Power Systems, 511 South Glenn Avenue, Wheeling, Ill., 60090.

All of the foregoing components are distributed by Southwestern Controls, P. O. Box 22351, Houston, Tex., 77027.

In addition to the components of the system heretofore described, a brief mention is appropriate in relation to collateral aspects of the invention.

For example, a service tower or stand 69 may be provided on a deck portion 70 of the service boat 2 so as to facilitate servicing of the burner unit 10.

Similarly, an L-shaped support bracket 71 may be carried adjacent the control house portion 15 of the vessel 2 and serve to support the boom 5 in the aft or storage position depicted in FIGS. 1 and 2. Support bracket 71 may comprise a lower, horizontally extending leg portion 72 operable to support the underside of the boom 5, with a pin-type connection unit 73 being operable to detachably pin the port side of the boom 5 to an upright bracket portion 74.

As an additional safety feature the pivot means 7 may also be provided with locking means operable to mechanically lock the boom 5 in selective positions of rotation relative to the pedestal 3.

Such locking means may comprise a plurality of tubular sockets 75 positioned at appropriate locations about the periphery of the support plate 33 and mounted between plate 33 and a lower, annular mounting plate 80. Such tubular sockets 75 would be operable to receive a locking pin 76 passed through a locking aperture 77 in a plate 78 carried by the pedestal column 16. (Plate 78 may also provide a ledge operable to support the lower end 79 of the cap 20 so as to appropriately position components of the bearing assemblies 26 and 27.)

With respect to the mechanical locking arrangement, it will be appreciated that by rotating the boom 5 until a desired position is attained and one of the sockets 75 is aligned with opening 77, a locking pin 76 may be then inserted so as to rigidify the boom 5 relative to the pedestal 3 and thus secure a desired position of rotation of the boom.

SUMMARY OF MAJOR ADVANTAGES AND OVERALL SCOPE OF INVENTION

The pedestal mounting arrangement for the burner-supporting boom, coupled with the rack and pinion drive mechanism, provides a reliable, structurally simple and effective mechanism permitting, with maximum ease and convenience, the installation of a burner-supporting boom on an offshore service boat.

The cantilever mounting arrangement coupled with the deck-mounted pedestal affords a swinging boom assembly which is advantageously devoid of supporting guide wires, etc.

The "overrun" protection afforded by the limited travel of the rack and pinion drive mechanism affirmatively assures that inadvertent and excessive rotation of the boom is not implemented, thereby avoiding damage to the vessel superstructure.

The wave-action-accommodating aspects of the invention serve to uniquely prevent or minimize damage to burner boom system components which could otherwise happen as a result of excessive boom movements engendered by wave-action-induced forces.

The outrigger mounting of the drive assembly, coupled with the pinion and ring gear drive train interconnecting the drive means and the pivot means, provides a mounting arrangement which is uniquely stable even though loads acting on the system may tend to induce some deflection of the pedestal 60. Should such deflection occur, both the pivot means 7 and the drive unit 13 would move together and in essence be isolated from adverse consequences of deflection of the pedestal 16.

Those skilled in the offshore art and familiar with the disclosure of this invention may recognize additions, deletions, substitutions or other modifications which would fall within the scope of the present invention as defined in the appended claims.

What is claimed is:

1. An apparatus for burning fluid at a burner mounted on a floating vessel subject to wave action, said apparatus comprising:
- floating vessel means;
- generally upright pedestal means;
- boom means mounted for swing movement across the surface of a body of water upon which said floating vessel means is floating;
- pivot means journaled on said pedestal means and supporting an inner portion of said boom means for said swinging movement;
- burner means carried by an outer portion of said boom means;
- outrigger means mounted on said pedestal means;
- drive means carried by said outrigger means and operable to engage and drive said pivot means to effect said swinging movement of said boom means; and
- wave-action-accommodating means operable to
  - sense the effects of wave-action-induced force acting on said boom means and tending to induce swinging movement of said boom means about said pedestal means and
  - apply a restraining force to said pivot means tending to counteract said wave-action-induced force acting on said boom means and tending to induce swinging movement of said boom means about said pedestal means.

2. An apparatus as described in claim 1 wherein:
- said pedestal means comprises
  - a generally upright column means mounted on a deck portion of said floating vessel means;
- said pivot means includes
  - cap means journaled on and enclosing the top of said column means; and
- said boom means is cantilever-mounted on said cap means.

3. An apparatus as described in claim 1 wherein:
- said drive means includes
  - pinion means,
  - rack means drivingly engaging said pinion means,
  - linearly reciprocable, hydraulically actuated, piston means operable to induce linear movement of said rack means, with said rack means imparting rotation to said pinion means,
- said pivot means includes
  - annular ring gear means drivingly engaged by said pinion means and carried by the outer periphery of said cap means; and
- said drive means being operable to limit the swinging movement of said pivot means to less than a full circle of rotation about said pedestal means.

4. An apparatus as described in claim 1 wherein:
- said wave-action-accommodating means includes
  - a source of hydrauic fluid,
  - flow-regulating means operable to regulate the flow rate of said hydraulic fluid from said source,
  - flow-direction-control means operable to receive hydraulic fluid from said flow-regulating means and selectively impart either of opposite directions of rotation to said pinion means, and
  - load-sensing means operable to receive hydraulic fluid from said flow-direction-control means, sense wave-action-induced force acting on said boom means, and reverse the actuating direction of said piston means in response to a reduction in driving load on said piston means caused by wave-action-induced forces acting on said boom means and tending to rotate said boom means about said pedestal means in the same direction of rotation as induced by said drive means.

5. An apparatus as described in claim 1 wherein:

said pedestal means comprises a generally upright column means mounted on a deck portion of said floating vessel means;

said pivot means includes cap means journaled on and enclosing the top of said column means;

said boom means is cantilever-mounted on said cap means;

said drive means includes pinion means, rack means drivingly engaging said pinion means, linearly reciprocable, hydraulically actuated, piston means operable to induce linear movement of said rack means, with said rack means imparting rotation to said pinion means, said pivot means includes annular ring gear means drivingly engaged by said pinion means and carried by the outer periphery of said cap means;

said drive means being operable to limit the swinging movement of said pivot means to less than a full circle of rotation about said pedestal means;

said wave-action-accommodating means includes a source of hydraulic fluid, flow-regulating means operable to regulate the flow rate of said hydraulic fluid from said source, flow-direction-control means operable to receive hydraulic fluid from said flow-regulating means and selectively impart either of opposite directions of rotation to said pinion means, and load-sensing means operable to receive hydraulic fluid from said flow-direction-control means, sense wave-action-induced force acting on said boom means, and reverse the actuating direction of said piston means in response to a reduction in driving load on said piston means caused by wave-action-induced forces acting on said boom means and tending to rotate said boom means about said pedestal means in the same direction of rotation as induced by said drive means.

* * * * *